US008891987B2

(12) United States Patent
Kihara et al.

(10) Patent No.: US 8,891,987 B2
(45) Date of Patent: Nov. 18, 2014

(54) COLOR IMAGE FORMING APPARATUS

(75) Inventors: Hideo Kihara, Yokohama (JP); Takuya Kitamura, Yokohama (JP); Yuji Kawaguchi, Tokyo (JP); Kouki Yano, Kawasaki (JP); Yuta Isobe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 346 days.

(21) Appl. No.: 13/468,459

(22) Filed: May 10, 2012

(65) Prior Publication Data

US 2012/0288293 A1 Nov. 15, 2012

(30) Foreign Application Priority Data

May 11, 2011 (JP) ..... 2011-106016

(51) Int. Cl.
*G03G 15/01* (2006.01)

(52) U.S. Cl.
USPC ..... 399/54; 399/227

(58) Field of Classification Search
CPC ..... G03G 15/0126; G03G 15/0824; G03G 15/0825; G03G 15/0831; G03G 15/0849; G03G 15/0851; G03G 15/0856; G03G 15/086; G03G 2215/0177; G03G 2215/0116
USPC ..... 399/54, 61, 223, 226, 227
See application file for complete search history.

(56) References Cited

U.S. PATENT DOCUMENTS

| | | | | |
|---|---|---|---|---|
| 5,124,751 | A * | 6/1992 | Fukui et al. | 399/44 |
| 6,476,837 | B2 * | 11/2002 | Ogata | 347/140 |
| 6,510,292 | B1 * | 1/2003 | Owen et al. | 399/27 |
| 7,095,964 | B2 * | 8/2006 | Koyama et al. | 399/24 |
| 7,389,059 | B2 * | 6/2008 | Tsukada et al. | 399/27 |
| 8,155,539 | B2 | 4/2012 | Kawasaki et al. | |
| 2009/0317138 | A1 | 12/2009 | Kawasaki et al. | |

FOREIGN PATENT DOCUMENTS

| | | | |
|---|---|---|---|
| JP | 2005134794 A | * | 5/2005 |
| JP | 2010-26497 A | | 2/2010 |

* cited by examiner

*Primary Examiner* — Robert Beatty
(74) *Attorney, Agent, or Firm* — Fitzpatrick, Cella, Harper & Scinto

(57) ABSTRACT

A color image forming apparatus includes an image bearing member for carrying an electrostatic latent image, a plurality of developing devices for developing the electrostatic latent image, a supporting member for moving the developing devices sequentially to a developing position opposing the image bearing member, and a detecting device for detecting developer remainder in the developing device. In addition, a determining portion determines the developer remainder. In the developing device in which the detecting operation is effected after the developing operation, the determining portion determines the developer remainder from the information relating to the detected developer remainder. In the developing device of the developing devices for which the detecting operation is effected before the developing operation, the determining portion determines the developer remainder from the information relating to the detected developer remainder and a deduced consumption amount.

12 Claims, 6 Drawing Sheets

COLOR IMAGE FORMING APPARATUS

FIELD OF THE INVENTION AND RELATED ART

The present invention relates to a color image forming apparatus which uses a development process which uses a rotary for holding developing devices.

A full-color image forming apparatus equipped with a single image bearing member and a rotatable developing device supporting member (rotary) for supporting multiple developing devices, has long been known. This type of full-color image forming apparatus uses such a development process that sequentially forms multiple electrostatic latent images on the peripheral surface of the image bearing member, with a preset interval, and sequentially develops the electrostatic latent images with corresponding developing devices, one for one, which are sequentially changed in positioned with the preset interval.

An image forming apparatus, such as the above described one, that employs a rotatable developing device supporting member for holding multiple developing devices, different in the color of the toner they use, is referred to as an image forming apparatus of the rotary type. It sequentially forms multiple electrostatic latent images on its single image bearing member, with a preset chronological interval, and develops each of the multiple electrostatic latent images, with the use of the developing device dedicated thereto in terms of color, by switching the developing devices in position by rotating the rotary.

There have been proposed various methods for detecting the amount of developer in an image forming apparatus of the rotary type. One of them has been proposed in Japanese Laid-open Patent Application 2010-26497. According to the technology disclosed in this patent application, the rotary is positioned so that one of the developing devices in the rotary is held in such an attitude that the developer in the area above the nip between the developer bearing member and developer supplying member in this developing device is allowed to fall through the nip between the developer bearing member and developer supplying member, and the amount of developer in the developing device is computed by detecting the electrostatic capacity between the developer bearing member and developer supplying member. Also according to this patent application, in terms of the rotational direction of the rotary, the position in which the developer amount is to be detected is different from the position in which a developing device is used for developing an electrostatic latent image. Therefore, the amount of developer in a developing device in the position in which the developer amount is to be detected can be detected while a developing device (different in color of developer from developing device in detection position) is used for development.

As described above, a full-color image forming apparatus in which the position, in terms of the rotational direction of the rotary, in which a given developing device is used for development is different from the position in which the amount of developer in a developing device is detected, and the amount of developer in a given developing device is detected while another developing device which is different in the color of the developer therein from the given developing device is being used for development, suffers from the following problem.

That is, when the developing device which uses the first color is being used for development, the developer amount in this developing device (which is in development position), and the developer amount in the developing device which is on the upstream side of this developing device and on the downstream side of the developer amount detection position, in terms of the rotational direction of the rotary, are detected after the developing devices are used for the on-going image formation.

In the case of these developing devices, the developer in each developing device is not consumed after the developer amount in the developing device is detected. Therefore, the developer amount detected in the developer amount detection position accurately reflects the amount of the developer in the developing device immediately after the ending of the on-going image forming operation. Thus, there is no problem.

However, the developing device which is in the developer amount detection position when the developing device for the first color is in the development position, and the developing device which is on the upstream side of the developer amount detection position and on the downstream side of the development position in terms of the rotational direction of the rotary, are used for development after their developer amount is detected.

In the case of these developing devices, the developer in each of these developing devices is consumed after the developer amount in these developing devices are detected. Therefore, the developer amount in these developing device after the ending of the on-going image forming operation is different from the developer amount in these developing devices detected in the developer amount detection position, by the amount by which the developer in these developing devices were used for development after the detection of the developer amount in these developing devices.

That is, if the developer in these developing devices is used by a large amount after the detection of the developer amount therein, some of these developing devices may be out of developer at the end of the image forming operation, even if it was determined that there was a sufficient amount of developer in these developing devices when the developer amount in these developing devices was detected. In other words, in a case where a given developing device in a full-color image forming apparatus runs out of developer after the developer amount therein is detected, the technology disclosed in the aforementioned patent application cannot inform a user that the given developing device is out of developer.

Therefore, it is during the next printing operation that a user is informed for the first time that one of the developing devices is out of developer. In the worst case, a print which suffers from unwanted white spots is outputted, and then, the user is informed that one of the developing devices is out of developer.

One of the solutions to this problem is to detect the developer amount in all the developing devices after the ending of an on-going image forming operation. This method, however, requires some developing devices to be moved into the developer amount detection position to detect the developer amount therein at the end of the image forming operation. That is, it requires an additional time just for detecting the developer amount.

Another method for estimating the developer amount in a developing device is the so-called pixel counting method, which counts the number of pixels to which developer (toner) is to be adhered per image during development in order to estimate the amount by which developer is used during an on-going image forming operation. This method makes it possible to instantly estimate (determine) the developer amount in each developing device during development. Therefore, it does not require an additional time for developer amount detection; it does not waste time just for developer amount detection. However, the amount by which developer is consumed per pixel is not constant. This creates a problem. In a case where only several prints are made, this inconsistency with which developer is consumed per pixel amounts to little error in the estimation of the developer amount in each developing device. However, in a case where a large number of prints are made, the cumulation of the inconsistency amounts to a large error in the estimation of the developer amount.

SUMMARY OF THE INVENTION

Thus, the primary object of the present invention is to provide an image forming apparatus capable of accurately informing a user of the developer amount in each of the developing devices of the apparatus at the end of each image forming operation, without requiring additional time just for detecting the developer amount in each of the developing devices.

According to an aspect of the present invention, there is provided a color image forming apparatus comprising an image bearing member for carrying an electrostatic latent image; a plurality of developing devices for effecting a developing operation for developing the electrostatic latent image; a supporting member, supporting said developing devices, for moving said supporting member sequentially to a developing position opposing said image bearing member; a detecting device for effecting a detecting operation at a position different from the developing position for detecting information relating to a developer remainder in said developing device; deducing means for deducing a consumption amount of the developer from image information; and a determining portion for determining the developer remainder, wherein in color image formation, as to said developing device of said developing devices for which the detecting operation of said detecting device is effected after the developing operation therefor, said determining means determines the developer remainder from the information relating to the developer remainder detected by said detecting device, and as to said developing device of said developing devices for which the detecting operation of said detecting device is effected before the developing operation therefor, said determining means determines the developer remainder from the information relating to the developer remainder detected by said detecting device and the consumption amount deduced by said deducing means.

According to the present invention, even in a case where the developer amount in one of the developing devices of a full-color image forming apparatus is detected while another developing device of the apparatus is being used for development, a user can be accurately informed of the amount by which developer will be in each of developing devices at the end of the on-going image forming operation, without requiring an additional time just for detecting the developer amount in the developing device, the developer amount of which is detected while another developing device is used for development.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the image forming apparatuses in the preferred embodiments of the present invention are concretely described with reference to the appended drawings.

<Overall Structure of Image Forming Apparatus>

Figure 1:
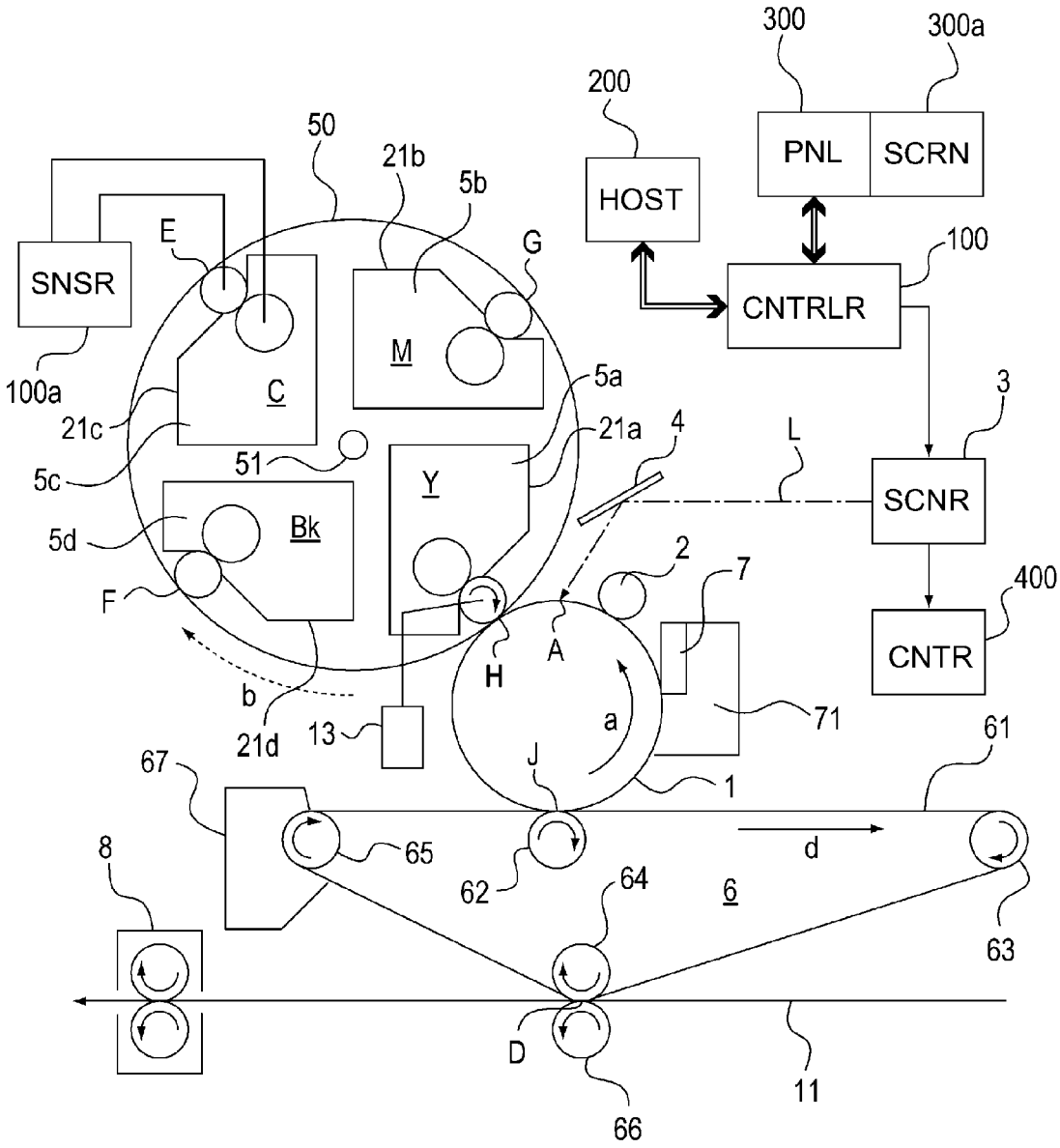
FIG. 1 is a schematic sectional view of one of the image forming apparatuses in accordance with the present invention.

FIG. 1 is a schematic sectional view of one of the typical image forming apparatuses in accordance with the present invention. It shows the overall structure of the apparatus. This image forming apparatus uses an electrophotographic image formation process, and is a full-color image forming apparatus which is based on four primary colors. To this image forming apparatus, electrical image formation signals are sent from a host apparatus 200 such as an image reader (apparatus for reading original), a personal computer, a facsimile machine, or the like.

It forms an image on a sheet 11 of recording medium (as recording medium) based on the aforementioned electrical image formation signals inputted into the controller section 100 of the CPU of the apparatus, which functions as a controlling means. Not only does the controller section 100 exchange various electrical information with the host apparatus 200 and the control panel portion 300 of the image forming apparatus, but also, integrally controls the image forming operation of the apparatus following one of the preset control programs, and referential tables.

This image forming apparatus has a rotatable electrophotographic photosensitive member 1 (which hereafter will be referred to simply as "photosensitive drum 1"), which is an image bearing member which bears an electrostatic latent image on its peripheral surface. It has also a charge roller 2 and a laser scanner unit 3. The charge roller 2 is one of the means for processing the photosensitive drum 1, more specifically, the means for charging the photosensitive drum 1. The laser scanner unit 3 is the means for exposing the photosensitive drum 1.

The image forming apparatus has also: multiple (four in this embodiment) developing devices 5 as the means for developing an electrostatic latent image formed on the photosensitive drum 1, into a visible image formed of developer (toner); a transfer unit 6 as a transferring means; and a cleaning blade as the means for cleaning the photosensitive drum 1. FIG. 1 shows developing devices 5*a*, 5*b*, 5*c*, and 5*d*, which contain yellow (Y), magenta (M), cyan (C) and black (Bk) toners, respectively. However, the four developing devices are the same in structure. Therefore, they may be described together simply as a developing device 5, and so may be the various components of developing devices described together.

The photosensitive drum 1 is driven so that it rotates about its shaft in the direction indicated by an arrow mark a in FIG. 1, at a preset peripheral velocity. The charge roller 2 uniformly charges the peripheral surface of the photosensitive drum 1 to a preset polarity (negative in this embodiment) and a preset potential level. The charge roller 2 in this embodiment is of the contact type. The laser scanner unit 3 forms an electrostatic latent image on the peripheral surface of the photosensitive drum 1.

More specifically, the laser scanner unit 3 scans (exposes), at the exposure line A, the uniformly charged portion of the peripheral surface of the photosensitive drum 1, with a beam L of laser light it outputs while modulating the beam L in accordance with the information about each of the monochromatic images (obtained by separating image to be formed), which is inputted into the controller section 100 from the host apparatus 200. As a result, an electrostatic latent image is formed on the peripheral surface of the photosensitive drum 1. In this embodiment, an electrostatic latent image is formed by exposing the uniformly charged portion of the peripheral surface of the photosensitive drum 1 in accordance with the information of the image to be formed.

The developing device 5 develops an electrostatic latent image on the peripheral surface of the photosensitive drum 1 into a visible image formed of developer (toner). The image forming apparatus in this embodiment has multiple (four) developing devices 5*a*-5*d*. The four developing devices 5*a*-5*d* are supported by a rotary 50 as a developing device supporting member. The rotary 50 is rotatable about its central shaft while supporting the developing devices 5*a*-5*d*. The rotary 50 is structured so that it is rotatable about its shaft 51, while holding the multiple (four) developing devices 5*a*-5*d*, in order to sequentially place the developing devices 5*a*-5*d* in the development position H where each developing device contacts the photosensitive drum 1.

The rotary 50 is rotatable about its shaft 51 in order to place a specific developing device among the multiple (four) developing devices 5*a*-5*d*, in the development position H. The rotary 50 is provided with multiple (four) developing device slots dedicated to the developing devices 5*a*-5*d*, one for one. That is, in terms of the rotational direction of the rotary 50, each developing device slot occupies 90° in terms of the rotational direction of the rotary 50. The rotary 50 is rotatable by a multiple of 90° by an unshown driving means, such as a motor, which is under the control of the controller section 100 so that one of the developing devices 5*a*-5*d* is placed in the developing position H. Thus, the developing devices 5*a*-5*d* can be sequentially moved into the development position H where each developing device is made to oppose the photosensitive drum 1 to develop an electrostatic latent image on the peripheral surface of the photosensitive drum 1 into a visible image formed of toner (which hereafter may be referred to simply as toner image).

As the rotary 50 is rotated by 90°, the developing device 5 in the development position H is moved from the development position H (where it opposes photosensitive drum 1) to a position F. Then, as the rotary 50 is rotated for the second time by 90° (180° from development position H), the developing device in the position F is moved from the position F into a position E where the developer amount in the developer container 21 of the developing device is detected. As the rotary 50 is rotated for the third time by 90° (270° from development position H), the developing device in the position E is moved into a position G.

Figure 2:
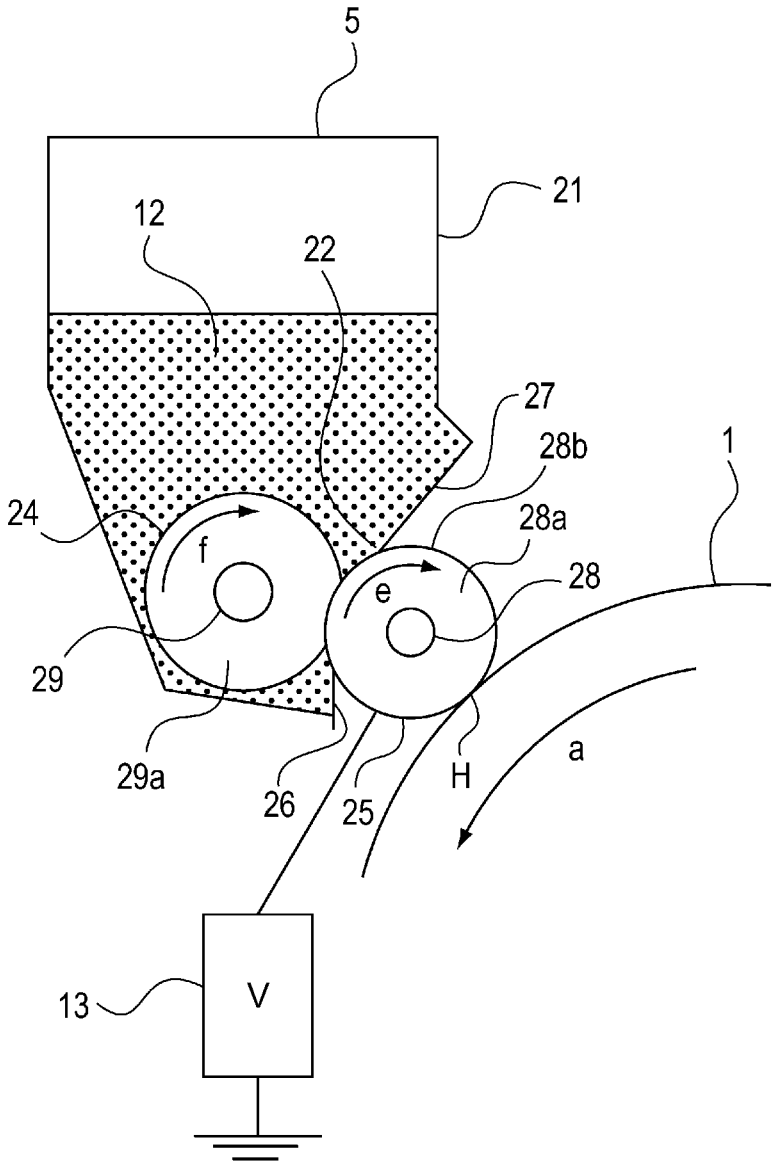
FIG. 2 is an enlarged schematic sectional view of one of the developing means of the image forming apparatus in accordance with the present invention, when the developing means is in the development position where the developing device is in contact with the image bearing member of the apparatus. It shows the structure of the developing device.

Each of the developing devices 5*a*-5*d* in this embodiment is such a developing apparatus that reversely develops an electrostatic latent image. It is of the contact type, and uses negatively chargeable nonmagnetic toner 12 as developer. Referring to FIG. 2, each developing device 5 has a development roller 25 and a developer container 21. The development roller 25 is a developer bearing member which develops an electrostatic latent image on the photosensitive drum 1 by supplying the photosensitive drum 1 with developer. The toner container 21 contains the toner 12 to be supplied to the development roller 25. The developing device 5*a* stores yellow (Y) toner in its developer container 21*a*. The developing device 5*b* contains magenta (M) toner in its developer container 21*b*. The developing device 5*c* contains cyan (C) toner in its developer container 21*c*. The developing device 5*d* contains black (Bk) toner in its developer container 21*d*.

The transfer unit 6 is a transferring means for transferring a toner image on the peripheral surface of the photosensitive drum 1 onto a sheet 11 of recording medium. The transfer unit 6 in this embodiment has a primary transfer roller 62, a driver roller 63, a secondary transfer counter roller 64, and a tension roller 65. It has also an intermediary transfer belt 61 (as intermediary transferring member), which is flexible and is made of a dielectric substance. It is suspended and kept stretched by these rollers 62, 63, 64 and 64. The primary transfer roller 62 is kept pressed against the photosensitive drum 1 with the presence of the intermediary transfer belt 61 between itself and the photosensitive drum 1.

The area of contact between the photosensitive drum 1 and intermediary transfer belt 61 is the primary transfer nip J. There is a secondary transfer roller 66, which opposes the secondary transfer counter roller 64 with the presence of the intermediary transfer belt 61 between itself and the roller 64. The secondary transfer roller 66 is selectively switchable in position by an unshown mechanism, between a position in which it is kept pressed against the secondary transfer counter roller 64 with the presence of the intermediary transfer belt 61 between itself and the roller 64, and a position in which it is kept separated from the surface of the intermediary transfer belt 61.

Normally, the secondary transfer roller 66 is kept in the position in which it is kept separated from the intermediary transfer belt 61. It is moved, with a preset control timing, into the position in which it is used for the secondary transfer. The area of contact between the secondary transfer roller 66 and intermediary transfer belt 61 when the secondary transfer roller 66 is in the position in which it is used for the secondary transfer is the secondary transfer nip D. The image forming apparatus is provided with a belt cleaning device 67 for cleaning the surface of the intermediary transfer belt 61. The belt cleaning device 67 is positioned so that it opposes the tension roller 65 with the presence of the intermediary transfer belt 61 between itself and the tension roller 65.

The belt cleaning device 67 is switchable in position by an unshown mechanism, between a position (first position) in which its cleaning member is kept in contact with the image bearing surface of the intermediary transfer belt 61, and a position (second position) in which its cleaning member is kept separated from the image bearing surface of the intermediary transfer belt 61. Normally, the cleaning member of the cleaning device 67 is kept in the second position. It is moved into the first position with preset control timing. The cleaning blade 7 is a means for removing from the peripheral surface of the photosensitive drum 1, the toner remaining on the peripheral surface of the photosensitive drum 1 after the transfer (primary transfer) of a toner image from the peripheral surface of the photosensitive drum 1 onto the intermediary transfer belt 61. The toner removed by the cleaning blade 7 from the peripheral surface of the photosensitive drum 1 is stored in the cleaning means container 71.

As an image formation start signal is inputted into the image forming apparatus, the controller section 100 begins to drive an unshown main motor of the apparatus, whereby the photosensitive drum 1 begins to be rotated in the direction indicated by the arrow mark a in FIG. 1, at the preset peripheral velocity. Then, the controller section 100 rotates the rotary 50 so that the developing device 5*a* is moved into the development position H. Then, it transmits driving force to the developing device 5*a*, and applies a preset development bias to the developing device 5*a*. Further, it drives the laser scanner unit 3, and circularly moves the intermediary transfer belt 61 in the direction indicated by an arrow mark d in FIG. 1 (same direction as moving direction of peripheral surface of photosensitive drum 1); at the same velocity as the peripheral velocity of the photosensitive drum 1.

The secondary transfer roller 66 and belt cleaning device 67 are kept in their second position where they are kept separated from the intermediary transfer belt 61. To the charge roller 2, a preset charge bias is applied, whereby the peripheral surface of the rotating photosensitive drum 1 is uniformly charged to a preset polarity (negative in this embodiment) and a preset potential level. Then, the uniformly charged portion of the peripheral surface of the photosensitive drum 1 is scanned by (exposed to) a beam L of laser light outputted from the laser scanner unit 3 while being modulated with the image formation signals which correspond to the yellow color component of the full-color image to be formed.

As a result, an electrostatic latent image, which reflects the image formation signals related to the yellow color component, is formed on the peripheral surface of the photosensitive drum 1. This electrostatic latent image is developed into a yellow (Y) toner image (developer image) by the developing device 5*a* in the development position H. In this embodiment, an electrostatic latent image is reversely developed with the use of negative toner, the intrinsic polarity of which is the same as the polarity (negative) to which the photosensitive drum 1 is charged. The yellow (Y) toner image is transferred (primary transfer) onto the surface of the intermediary transfer belt 61 in the primary transfer nip J. To the primary transfer roller 62, the primary transfer bias is applied with preset control timing. The primary transfer bias is preset in potential level, and is opposite (positive) in polarity to the toner. After the primary transfer, the peripheral surface of the photosensitive drum 1 is cleaned by the cleaning blade 7.

As the electrostatic latent image on the photosensitive drum 1 is developed into the yellow (Y) toner image, and transferred (primary transfer) onto the intermediary transfer belt 61, the rotary 50 is rotated by 90° in the direction indicated by an arrow mark b in FIG. 1, whereby the developing device 5*b* is moved into the development position H. Then, the photosensitive drum 1 is subjected to the charging, exposing, and developing processes for forming a magenta (M) toner image, which corresponds to the magenta color component of the full-color image to be formed. Then, the magenta (M) toner image is transferred (primary transfer) onto the intermediary transfer belt 61 in the primary transfer nip J in such a manner that it is layered upon the yellow (Y) toner image on the intermediary transfer belt 61, in alignment with the yellow (Y) toner image.

As the transfer (primary transfer) of the magenta (M) toner image onto the intermediary transfer belt 61 ends, the rotary 50 is rotated by 90° in the direction indicated by the arrow mark b in FIG. 1, whereby the developing device 5*c* is moved into the development position H. Then, the photosensitive drum 1 is subjected to the charging, exposing, and developing processes for forming a cyan (C) toner image, which corresponds to the cyan color component of the full-color image to be formed. Then, the cyan (C) toner image is transferred (primary transfer) onto the intermediary transfer belt 61 in the primary transfer nip J in such a manner that it is layered upon the yellow (Y) and magenta (M) toner images on the intermediary transfer belt 61, in alignment with the yellow (Y) and magenta (M) toner images.

As the transfer (primary transfer) of the cyan (C) toner image onto the intermediary transfer belt 61 ends, the rotary 50 is rotated by 90° in the direction indicated by the arrow mark b in FIG. 1, whereby the developing device 5*d* is moved into the development position H. Then, the photosensitive drum 1 is subjected to the charging, exposing, and developing processes for forming a black (Bk) toner image, which corresponds to the black color component of the full-color image to be formed. Then, the black toner image is transferred (primary transfer) onto the intermediary transfer belt 61 in the primary transfer nip J in such a manner that it is layered upon the yellow (Y), magenta (M) and cyan (C) toner images on the intermediary transfer belt 61, in alignment with the yellow (Y), magenta (M) and cyan (C) toner images.

As a result, an unfixed full-color toner image is synthetically effected on the intermediary transfer belt 61 by the yellow (Y), magenta (M), cyan (C) and black (Bk) monochromatic toner images.

That is, one of the developing devices 5 is moved into the development position H (where it opposes photosensitive drum 1) by rotating the rotary 50 by the unshown driving means such as a motor. Then, an electrostatic latent image on the photosensitive drum 1 is developed into a toner image by the developing device 5 in the development position H. This operational sequence is sequentially carried out for the developing devices 5*a*, 5*b*, 5*c* and 5*d* to form an unfixed full-color toner image on the intermediary transfer belt 61.

Incidentally, the order in which the four monochromatic toner images, that is, yellow (Y), magenta (M), cyan (C) and black (Bk) toner images, are formed on the photosensitive drum 1 does not need to be limited to the order in which they are formed in this embodiment; it is optional.

Before the leading edge of the unfixed full-color toner image, made up of four monochromatic toner images and different in color, on the intermediary transfer belt 61 is made to reach the secondary transfer nip D (where secondary transfer roller 66 opposes secondary transfer counter roller 64) by the movement of the intermediary transfer belt 61, the secondary transfer roller 66 is moved into its first position (where it is kept in contact with intermediary transfer belt 61), and the belt cleaning device 67 also is moved into its first position (where it is kept in contact with intermediary transfer belt 61).

Meanwhile, the sheets 11 of recording medium in the unshown recording medium feeding section of the image forming apparatus are fed one by one into the main assembly of the apparatus from the recording medium feeding section while being separated from those in the feeding section, and are conveyed further into the main assembly. Then, each sheet 11 of recording medium is introduced by unshown registration roller unit, into the secondary transfer nip D, which is the area of contact between the secondary transfer roller 66 and intermediary transfer belt 61, with preset control timing. To the secondary transfer roller 66, secondary transfer bias is applied, which is opposite (positive) in polarity to the toner. With the application of the secondary transfer bias to the secondary transfer roller 66, the four monochromatic toner images (different in color and layered on the intermediary transfer belt 61), of which the full-color toner image is made on the intermediary transfer belt 61, are transferred together (secondary transfer) onto the sheet 11 of recording medium while the sheet 11 is conveyed through the secondary transfer nip D, remaining pinched between the intermediary transfer belt 61 and secondary transfer roller 66.

As the sheet 11 of recording medium is conveyed out of the secondary transfer nip D, it is separated from the surface of the intermediary transfer belt 61, and is introduced into a fixation unit 8, which is made up of a heat roller and a pressure roller. The heat roller and pressure roller are kept pressed against each other, forming the fixation nip between the two rollers; the area of contact between the two rollers is the fixation nip. The sheet 11 is conveyed through the fixation nip of the fixation unit 8. As the sheet 11 is conveyed through the fixation nip, the sheet 11 and the four monochromatic toner images, different in color, thereon are subjected to heat and pressure, whereby the four monochromatic toner images are fixed to the sheet 11 (while becoming mixed). After the sheet 11 is conveyed out of the fixation unit 8, it is discharged as a full-color print, into an unshown delivery section.

The secondary transfer residual toner, that is, the toner remaining on the image bearing surface of the intermediary transfer belt 61 after the separation of the sheet 11 of recording medium from the intermediary transfer belt 61, is removed by the belt cleaning device 67.

After the ending of an image forming operation in which only a single print is outputted, or an image forming operation in which multiple prints are outputted, the controller section 100 puts the image forming apparatus on standby, and waits for the inputting of the next image formation start signal. That is, the controller section 100 stops driving the photosensitive drum 1, laser scanner unit 3, intermediary transfer belt 61, etc. Further, it moves the secondary transfer roller 66 and belt cleaning device 67 into their second position (where they are kept separated from intermediary transfer belt 61).

<Developing Apparatus>

In this embodiment, the four developing devices 5*a*-5*d* are the same in structure, although they are different in the color of the developer (toner) they store in their developer container 21.

FIG. 2 is an enlarged schematic sectional view of one of the developing devices 5 of the image forming apparatus when the developing device 5 is in the development position H. It shows the structure of the developing device 5. The developing device 5 has: the developer container 21 which stores the toner 12 as developer; the development roller 25, as a developer bearing member, for developing an electrostatic latent image formed on the photosensitive drum 1; and a developer (toner) application roller 24 as a developer applying member which is placed in contact with the development roller 25 to supply the development roller 25 with toner. The developing device 5 has also: a regulation blade 27 as a member for controlling in thickness the toner layer on the peripheral surface of the development roller 25; and a seal 26 for preventing toner from leaking through the gap between the development roller 25 and developer container 21.

The developer container 21 is a rectangular container, the lengthwise direction of which is parallel to the axial line of the photosensitive drum 1. Its bottom section has an opening 22, which extends in the lengthwise direction of the developer container 21. The opening 22 is positioned so that it faces the photosensitive drum 1 when the developing device 5 is in the development position H. The development roller 25 is positioned in parallel to the developer container 21 in such a manner that its peripheral surface faces the opening 22 of the developer container 21. It is rotatably supported by the developer container 21. More concretely, the lengthwise end walls of the developer container 21 are provided with an unshown pair of bearings, one for one, and the development roller 25 is supported by the unshown pair of bearings, by its lengthwise ends, one for one.

The developer application roller 24 is positioned in the developer container 21 in parallel to the development roller 25 in such a manner that when the developing device 5 is in the development position H, it is on the opposite side of the development roller 25 from the photosensitive drum 1. It also is rotatably supported by the developer container 21. More concretely, the lengthwise end walls of the developer container 21 are provided with an unshown pair of bearings, one for one, and the developer application roller 24 is supported by the unshown pair of bearings, by its lengthwise ends, one for one.

In this embodiment, the development roller 25 is 13 mm in external diameter. It is made up of a metallic core 28, a base layer 28*a*, and a surface layer 28*b*. The metallic core 28 is electrically conductive, and is 8 mm in external diameter. The base layer 28*a* is formed of silicone rubber, and covers the entirety of the peripheral surface of the metallic core 28. The surface layer 28*b* is formed of acrylic/urethane rubber, and is coated on the peripheral surface of the base layer 28*a*. The volume resistivity of the development roller 25 is in a range of $10^4$ Ω·cm-$10^{12}$ Ω·cm.

The developer application roller 24 is 15 mm in external diameter, and is made up of an electrically conductive metallic core 29, and a urethane sponge layer 29*a*. The metallic core 29 is 6 mm in external diameter. The urethane sponge layer 29*a* covers the entirety of the peripheral surface of the metallic core 29. Its pores are in connection with one another. The volume resistivity of the urethane sponge layer 29*a* is in a range of $10^4$ Ω·cm-$10^{12}$ Ω·cm.

The distance between the metallic core 28 of the development roller 25 and the metallic core 29 of the developer application roller 24 is 13 mm. The development roller 25 and developer application roller 24 are positioned so that the development roller 25 compresses the urethane sponge layer 29*a* of the developer application roller 24 by 1.0 mm.

The regulation blade 27 is a flexible member made of phosphor bronze, urethane rubber, etc. It is positioned so that its free edge rubs the peripheral surface of the development roller 25 to form the toner on the peripheral surface of the development roller 25 into a thin layer of toner after the coating of toner onto the peripheral surface of the development roller 25 by the developer application roller 24. The regulation blade 27 is attached to the top edge portion of the aforementioned opening 22 of the developer container 21, by its base portion.

The seal 26 is a flexible member. It is positioned so that its free edge contacts the development roller 25 to cover (seal) the gap between the bottom portion of the development roller 25 and the developer container 21 to prevent the toner in the developer container 21 from leaking.

Referring to FIGS. 1 and 2, when it is necessary for a given developing device 5 to be used for developing an electrostatic latent image on the photosensitive drum 1, the rotary 50 is rotated by a preset angle to move the developing device 5 into the development position H in which the developing device 5 opposes the photosensitive drum 1.

In this embodiment, the development roller 25 of the developing device 5*a* is in contact with the photosensitive drum 1. The development roller 25 develops an electrostatic latent image formed on the photosensitive drum 1, by being kept in contact with the photosensitive drum 1. That is, the developing device 5*a* uses the so-called contact developing method.

To the developing device 5 in the development position H, the force for driving the developing device 5, and the development bias, are inputted from unshown driving means and electric power source, respectively, of the main assembly of the image forming apparatus during image formation. The development roller 25 is driven so that it rotates in the direction indicated by an arrow mark e in FIG. 2, at a preset speed. The direction in which the peripheral surface of the development roller 25 moves in the area of contact between the development roller 25 and photosensitive drum 1 is the same as the peripheral surface of the photosensitive drum 1 moves in the area of contact between the development roller 25 and photosensitive drum 1. The developer application roller 24 which is placed in contact with the development roller 25 to supply the development roller 25 with the toner 12 is rotationally driven in the direction indicated by an arrow mark f in FIG. 2, at a preset speed. The direction f in which the peripheral surface of the developer application roller 24 moves in the area of contact between the developer application roller 24 and development roller 25 is opposite (counter) to the direction e in which the peripheral surface of the development roller 25 moves in the area of contact between the developer application roller 24 and development roller 25.

As the development roller 25 is rotated, the peripheral surface of the development roller 25 is coated with the toner 12 by the rotating developer application roller 24. Then, the toner 12 coated on the peripheral surface of the development roller 25 is formed into a thin layer of a preset thickness, and is conveyed by the subsequent rotation of the development roller 25 to the development position H where the development roller 25 opposes the photosensitive drum 1. To the development roller 25, a preset development bias (which in this embodiment is DC voltage) is applied from a development bias power source 13.

As the development bias is applied to the development roller 25, toner in the thin toner layer on the peripheral surface of the development roller 25 selectively transfer onto the pixels of the electrostatic latent image on the peripheral surface of the photosensitive drum 1, whereby the electrostatic latent image is developed into a toner image. The toner 12, which was not used for the development of the electrostatic latent image is returned into the developer container 21 by the subsequent rotation of the development roller 25, and is removed from the peripheral surface of the development roller 25 by the developer application roller 24, while the peripheral surface of the development roller 25 is coated again with the toner 12 by the developer application roller 24. This operational sequence is repeated to develop the electrostatic latent image on the peripheral surface of the photosensitive drum 1.

<Method for Detecting Residual Toner Amount in Developing Device>

Next, the method, in this embodiment, for detecting the residual toner amount in the developing device 5 is described. In this embodiment, the toner amount detecting method based on pixel count, and the toner amount detecting method based on electrostatic capacity are used in combination.

First, the toner amount detecting method based on pixel count is described. The toner amount detection method based on pixel count uses a pixel counter 400, as a pixel counting means, which is capable of calculating the amount of light emitted by the laser scanner 3. More concretely, the number of pixels of the image to be formed, to which toner is to be adhered, is calculated by the pixel counter 400, based on the information of the image to be formed, and the amount by which the toner 12 (developer) will be used is estimated. The preset amount by which the toner 12 is to be used per pixel is stored in the main assembly memory, and the amount by which the toner 12 will be used is estimated based on the cumulative number of the pixels (to which the toner 12 is to be adhered) obtained by the pixel count 400 (That is, pixel counter 400, as estimating means, estimates amount of toner consumption, based on information of image to be formed).

Next, the residual toner amount detecting method of the electrostatic capacity measurement type is described. The surface layer of the developer application roller 24 in this embodiment is a porous layer. More concretely, the developer application roller 24 has a surface layer 29*a* made of urethane sponge, the pores of which are in connection with one another. The urethane sponge layer 29*a*, the pores of which are in connection with one another, has such a characteristic that the amount by which toner can be held in the urethane sponge layer 29*a* is affected by the "air-permeability" of the urethane sponge layer 29*a*, that is, one of the physical properties of a piece of sponge, the pores of which are in connection with one another.

This physical property called "air-permeability" indicates the amount by which air is allowed to pass through an object. That is, the smaller the opening of each of the surface pores of the urethane sponge layer 29*a*, the smaller in air-permeability the urethane sponge layer 29*a*. Further, the smaller and denser in the internal pore structure of the urethane sponge layer 29*a*, the smaller in air-permeability the urethane sponge layer 29*a*. On the contrary, the larger the urethane sponge layer 29*a* in the size of a surface pore, the greater it is in air-permeability. Further, the larger the urethane sponge layer 29*a* in the size of its internal cell, the greater it is in air-permeability.

Figure 3:
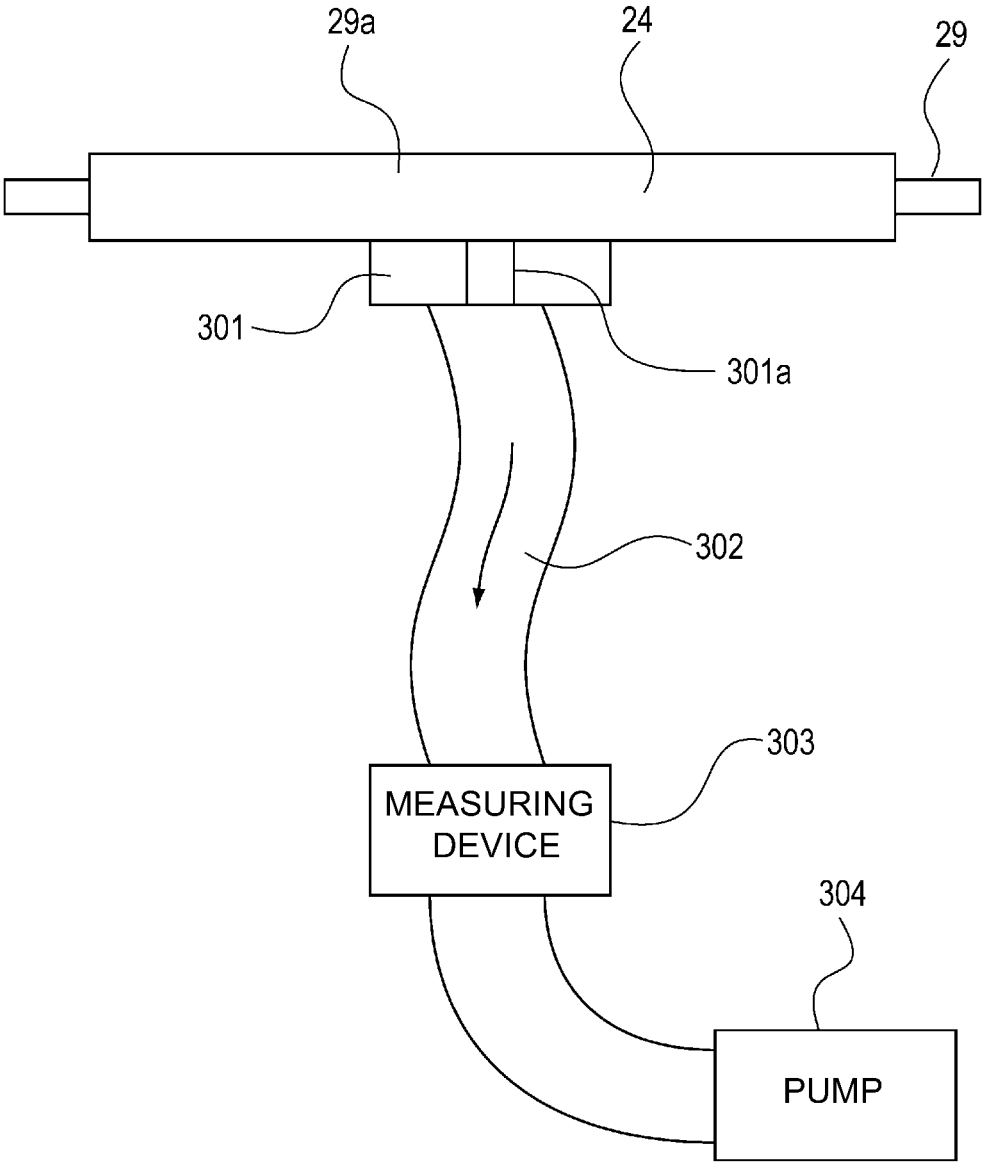
FIG. 3 is a schematic drawing for showing the method for measuring the air permeability of the developer application roller in the developer container of a developing device.

In other words, the amount by which toner can be held in the urethane sponge layer 29*a* is affected by the change in the air-permeability of the urethane sponge layer 29*a*. At this time, the aforementioned method for measuring the amount of air-permeability of the urethane sponge layer 29*a* is described. Referring to FIG. 3, which is a schematic drawing for showing the method for measuring the amount of air-permeability of the urethane sponge layer 29*a*, an acrylic plate 301 having a hole 301*a*, which is 100 mm in diameter, is placed in contact with the peripheral surface of the urethane sponge layer 29*a* of the developer application roller 24, in such a manner that the hole 301*a* is covered with the urethane sponge layer 29*a*.

Then, a hose 302, which is larger in internal diameter than the hole 301*a* is attached to the acrylic plate 301 in such a manner that the hole 301*a* becomes continuous with the hole of the hose 302. Then, the amount of air-permeability of the urethane sponge layer 29*a* is measured with an air-permeability measurement device 303 (for example, KZ type air-permeability tester: product of Daiei Kagaku Seiki MFG Co., Ltd.) while suctioning air by a pump 304, which is 10.8 [liter/min] in capacity, without the presence of the developer application roller 24. According to the experiments carried out by the inventors of the present invention, the urethane sponge layer 29*a* was desired to be no less than 2 [liter/min] in air-permeability.

Figure 4:
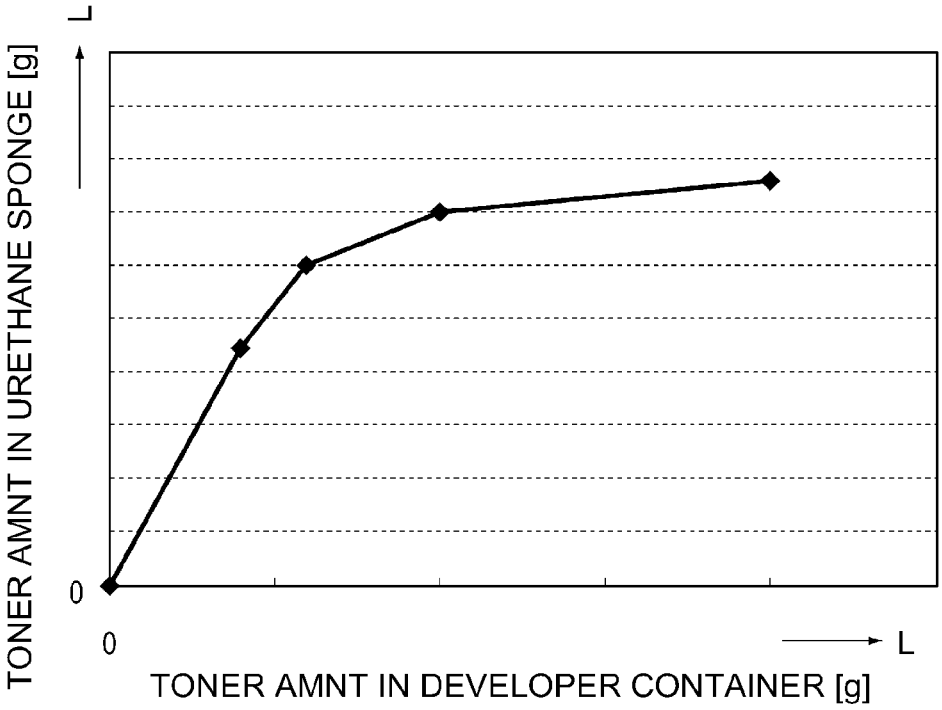
FIG. 4 is a graph which shows the relationship between the amount of toner in the developer container of a developing device, and the amount of toner in the sponge layer of the developer application roller in the developer container.

Shown in FIG. 4 is the relationship between the amount by which toner was held in the urethane sponge layer 29*a* of the developer application roller 24 and the amount of toner in the developer container 21 when a roller which had been optimized in the amount of air-permeability was used as the developer application roller 24. As will be evident from FIG. 4, there is a tendency that as the amount of toner in the developer container 21 reduces, the amount of toner held in the urethane sponge layer 29*a* of the developer application roller 24 reduces. That is, it is evident that there is a correlation between the amount of toner held in the urethane sponge layer 29*a* of the developer application roller 24 and the amount of toner in the developer container 21.

Figure 5:
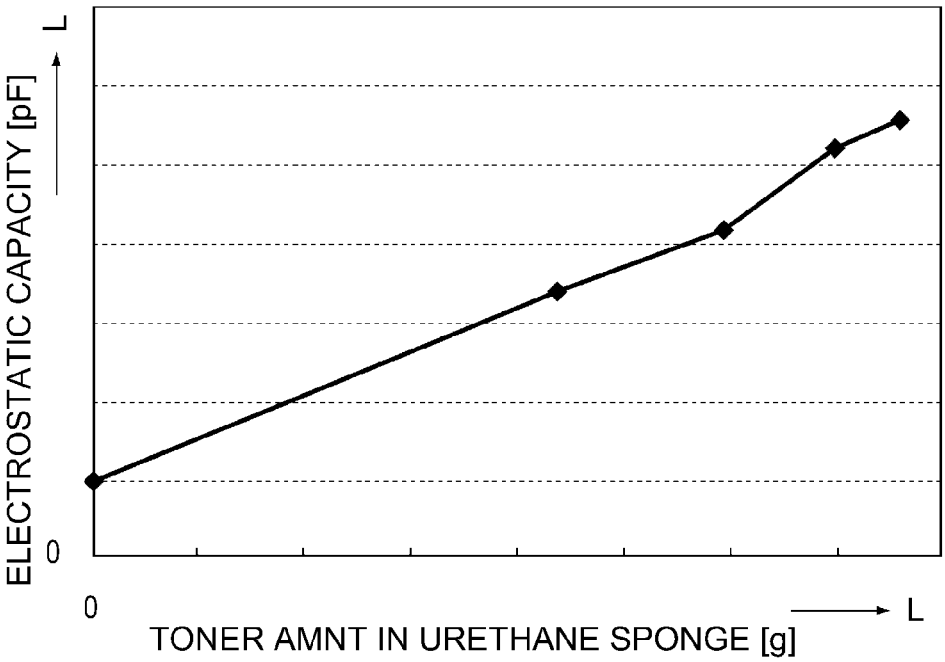
FIG. 5 is a graph which shows the relationship between the amount of toner in the sponge layer of the developer application roller in the developer container of a developing device, and the electrostatic capacity between the developer application roller and developer bearing member in the developer container of the developing device.

Shown in FIG. 5 is the relationship between the amount by which toner is held in the urethane sponge layer 29*a* and the electrostatic capacity between the developer application roller 24 and development roller 25, which was measured with an LCR meter ZM2354 (product of NF Co., Ltd.) As is evident from FIG. 5, there is a linear relationship between the amount of toner held in the urethane sponge layer 29*a* and the amount of electrostatic capacity between the developer application roller 24 and development roller 25.

That is, there is a correlation between the amount by which toner is held in the urethane sponge layer 29*a* of the developer application roller 24 and the electrostatic capacity between the developer application roller 24 and development roller 25. In other words, the amount of the toner in the urethane sponge layer 29*a* of the developer application roller 24 can be obtained (estimated) by measuring the electrostatic capacity between the developer application roller 24 and development roller 25, and the residual amount of toner (developer) in the developer container 21 can be estimated based on the amount of toner in the urethane sponge layer 29*a* of the developer application roller 24.

Figure 6:
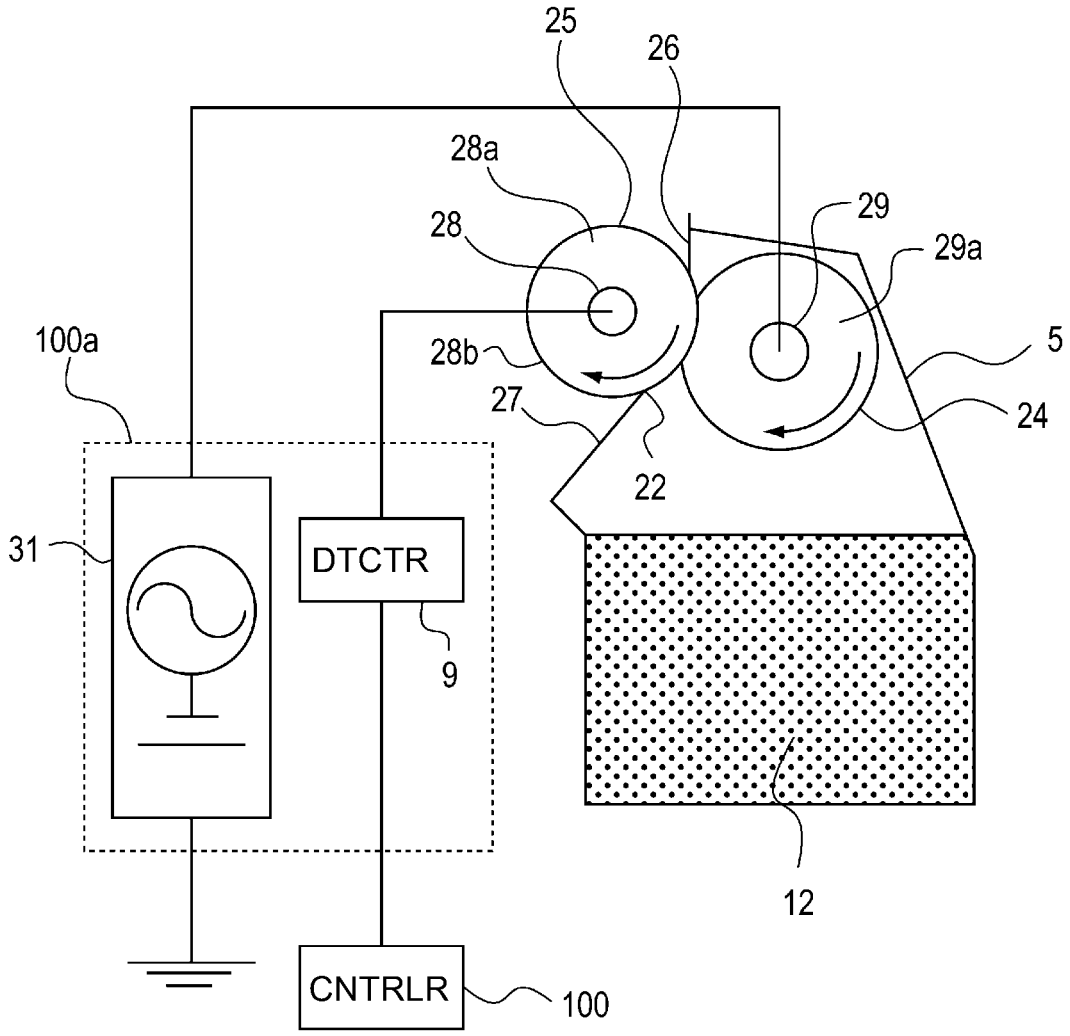
FIG. 6 is a combination of an enlarged schematic sectional view of one of the developing devices of an image forming apparatus in accordance with the present invention, and the means for detecting the amount of developer in the developer container of the developing means, when the developing means is in the developer amount detection position. It shows the structure of the developer amount detecting means.

In this embodiment, a residual toner amount detecting device 100*a*, which is the means for detecting the developer amount in the developer container 21, is in a detection position E, which is different from the development position H where the development roller 25 opposes the photosensitive drum 1 as shown in FIG. 1. FIG. 6 shows the structure of the residual toner amount detecting device 100*a*. The residual toner amount detecting device 100*a* detects the electrostatic capacity between the metallic core 29 of the developer application roller 24 and the metallic core 28 of the development roller 25 (That is, electrostatic capacity of a pair of electrodes, that is, metallic cores 29 and 28, is detected as information related to residual toner amount). Then, the amount of the toner in the urethane sponge layer 29*a* of the developer application roller 24 is computed from the electrostatic capacity between the two metallic rollers 29 and 28, and then, the residual toner amount in the developer container 21 is computed from the relationship shown in FIG. 4.

In order to detect the residual toner amount in the developer container 21, the residual toner amount detecting device 100*a* applies a residual toner amount detection bias to the metallic core 29 of the developer application roller 24 from a bias application power source 31. The residual toner amount detecting device 100*a* in this embodiment is 5 kHz in frequency and 200 V in Vpp. The alternating voltage induced in the electrically conductive metallic core 28 of the development roller 25 is rectified by a detection circuit 9. Then, the voltage itself of the DC voltage obtained by the rectification, or the electrical signals obtained by digitizing the DC voltage, is outputted as the information about the electrostatic capacity. It is from this output that the residual toner amount in the developer container 21 is determined by the controller section 100.

Next, the method for measuring (determining) the toner amount in the developer container 21 with use of the combination of the aforementioned pixel counter 400 and the residual toner amount detecting device 100*a* (which detects electrostatic capacity between metallic cores 29 and 28) while an image is formed is described.

Referring to FIG. 1, in this embodiment, the developing devices 5*a*, 5*b*, 5*c* and 5*d* are sequentially moved into the development position H (where they oppose the photosensitive drum 1) in the listed order, to develop an electrostatic latent image on the photosensitive drum 1. When the developing device 5*a* is in the development position H, the developing device 5*c* is in the developer amount detection position E, and when the developing device 5*b* is in the development position H, the developing device 5*d* is in the developer amount detection position E. Further, when the developing device 5*c* is in the development position H, the developing device 5*a* is in the developer amount detection position E, and when the developing device 5*d* is in the development position H, the developing device 5*b* is in the developer amount detection position E. Thus, the first developing device 5, the residual toner amount of which is detected by the residual toner amount detecting device 100*a*, is the developing device 5*c*. Then, the developing devices 5*d*, 5*a*, 5*b* are detected in the amount of toner in their developer container 21 by the residual toner amount detecting device 100*a* in the listed order.

In other words, the residual toner amount detecting device 100*a* detects the residual toner amount in the developing device 5*c* while the developing device 5*a* is used for development. It detects the residual toner amount in the developing device 5*d* while the developing device 5*b* is used for development. It detects the residual toner amount in the developing device 5*a* while the developing device 5*c* is used for development. Further, it detects the residual toner amount in the developing device 5*b* while the developing device 5*d* is used for development is detected.

Referring to FIG. 1, it is before the developing devices 5*c* and 5*d* are used for development that the residual toner amount in the developing devices 5*c* and that in the developing device 5*d* are detected by the residual toner amount detecting device 100*a*. Thus, the amount by which the developer in the developing device 5*c* is used for development is detected (estimated) by the pixel counter 400 while the developing device 5*c* is used for development, and the amount by which the developer in the developing device 5*d* is used for development is detected while the developing device 5*d* is used for development.

The amount by which the cyan (C) toner is used for developer by the developing device 5*c* is detected by the pixel counter 400 while the developing device 5*a* is used for development. The value obtained by subtracting the residual toner amount in the developer container 21 of the developing device 5*c* detected by the residual toner amount detecting device 100*a* before the developing device 5*c* is used for development, from the amount of the cyan (C) toner consumption computed by the pixel counter 400 is the residual toner amount in the developer container 21 of the developing device 5*c* after the development (ending of the on-going image forming operation). An operation similar to that carried out for the developing device 5*c* is carried out for the developing device 5*d*.

That is, the residual toner amount in the developing device 5*a* and that in the developing device 5*b* at the end of the on-going image forming operation are those detected by the residual toner amount detecting device 100*a*, whereas the residual toner amount in the developing device 5*c* and that in the developing device 5*d* at the end of the on-going image forming operation are the values obtained by subtracting the amounts of toner consumption estimated by the pixel counter 400 from the values obtained by the residual toner amount detecting device 100*a*. That is, for the developing devices, the residual developer amount of which is detected by the residual toner amount detecting device 100*a* after they are used for development in a color image forming operation, the controller section 100 determines the residual developer amount therein based on the information regarding the residual toner amount detected by the residual toner amount detecting device 100*a*. For the developing devices, the residual developer amount of which is detected by the residual toner amount detecting device 100*a*, the controller 100 determines the residual developer amount therein based on a combination of the information regarding the residual developer amount detected by the residual toner amount detecting device 100*a*, and the information regarding the developer consumption amount estimated with the use of the pixel counter 400.

Figure 7:
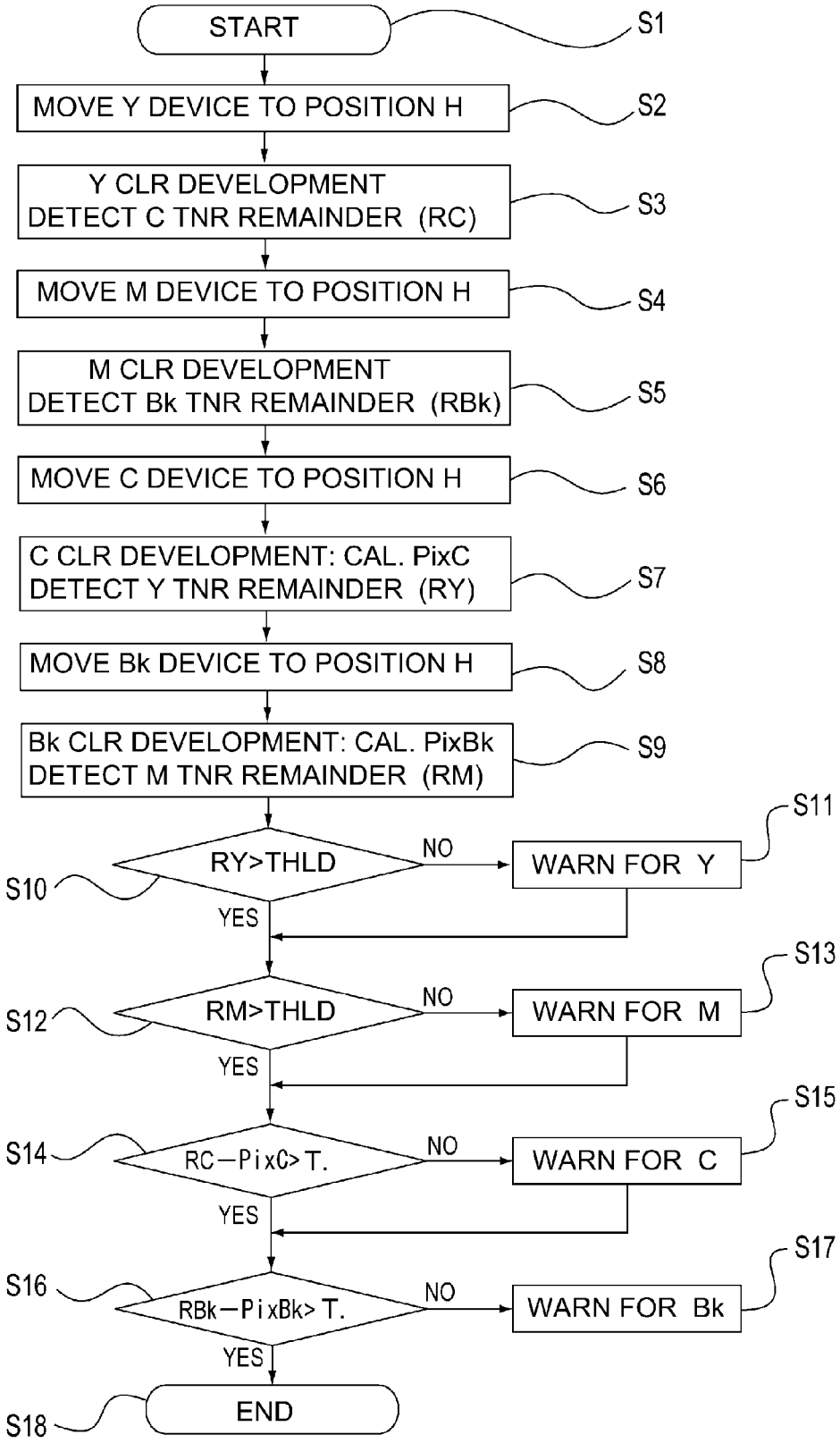
FIG. 7 is a flowchart of the operational sequence for detecting the amount of developer in the developer container of one of the developing devices of the image forming apparatus in accordance with the present invention, when the developer amount is detected while the developing device is in the developer amount detection position.

The residual toner amounts obtained through the above described processes are compared with a preset threshold value for predicting the remaining length of the service life of the developing device 5. If the residual toner amount in any of the developing devices 5 is no more than the threshold value (no more than preset amount), the control section 100 displays, on the display 300*a* of the control panel 300, a message for warning a user that the developing device 5 is close to the end of its service life. FIG. 7 is a flowchart of the operational sequence carried out to measure the residual toner amount in the developing devices 5 while an image is being formed.

Referring to FIG. 7, as an image forming operation is started in Step S1, the yellow (Y) developing device 5*a* is moved into the development position H (Step S2). Then, the residual toner amount RC in the developer container 21*c* of the developing device 5*c* (for cyan (C) color) in the developer amount detection position E is detected by the residual toner amount detecting device 100*a* while the electrostatic latent image on the photosensitive drum 1 is developed into a yellow (Y) toner image by the developing device 5*a* (Step S3).

Next, in Step S4, the developing device 5*b* for magenta (M) color is moved into the development position H. Then, the residual toner amount RBk in the developer container 21*d* of the developing device 5*d* (for black (Bk) color) in the developer amount detection position E is detected by the residual toner amount detecting device 100*a* while the electrostatic latent image on the photosensitive drum 1 is developed into a magenta (M) toner image by the developing device 5*b* (Step S5).

Next, in Step S6, the developing device 5*c* for cyan (C) color is moved into the development position H. Then, in Step S7, the amount PixC by which cyan (C) toner will be consumed by the on-going image forming operation is calculated by the pixel counter 400 while the electrostatic latent image on the photosensitive drum 1 is developed into a cyan (C) toner image by the developing device 5*c*. Further, the residual toner amount RY in the developer container 21*a* of the developing device 5*a* (for yellow (Y)) in the detection position E is detected by the residual toner amount detecting device 100*a*.

Next, in Step S8, the developing device 5*d* (for black (Bk) color) is moved into the development position H. Then, in Step S9, the amount PixBk by which black (Bk) toner will be consumed by the on-going image forming operation is calculated by the pixel counter 400 while the electrostatic latent image on the photosensitive drum 1 is developed into a black (Bk) toner image by the developing device 5*d*. Further, the residual toner amount RM in the developer container 21*b* of the developing device 5*b* (for magenta (M)) in the detection position E is detected by the residual toner amount detecting device 100*a*.

Next, in Step S10, it is determined whether or not the residual toner amount RY in the developer container 21*a* of developing device 5*a* (for yellow (Y) color) detected in Step S7 is no more than the preset threshold value. If it is no more than the threshold value, the control section 100 advances to Step S11 in which it displays a warning about the service life of the developing device 5*a* (for yellow (Y) color), on the display 300*a* of the control panel 300. If the residual toner amount RY in the developer container 21*a* of the developing device 5*a* (for yellow (Y) color) detected in Step S7 is no less than the preset threshold value, the control section 100 advances to Step S12.

Next, in Step S12, it is determined whether or not the residual toner amount RM in the developer container 21*b* of the developing device 5*b* (for magenta (M) color) detected in Step S9 is no more than the preset threshold value. If it is no more than the threshold value, the control section 100 advances to Step S13, in which it displays a warning about the service life of the developing device 5*b* (for yellow (Y) color), on the display 300*a* of the control panel 300. If the residual toner amount RM in the developer container 21*b* of the developing device 5*b* (for yellow (Y) color) detected in Step S12 is no less than the preset threshold value, the control section 100 advances to Step S14.

Next, in Step S14, the controller section 100 subtracts the amount PixC by which the cyan (C) toner in the developing device 5*c* would have been consumed by development, and which was obtained in Step S7 by the pixel counter 400 while the developing device 5*c* is used for development, from the residual toner amount RC in the developer container 21*c* in the developing device 5*c* (for cyan (C) color) detected in Step S3. If the difference is no more than the preset threshold value, the controller section 100 advances to Step S15, in which it displays a warning about the service life of the developing device 5*c* (for cyan (C) color), on the display 300*a* of the control panel 300.

Further, if the difference is no less than the preset threshold value, the controller section 100 advances to Step S16.

Next, in Step S16, the controller section 100 subtracts the amount PixBk by which the black (Bk) toner in the developing device 5*d* would have been consumed by development, and which was obtained in Step S9 by the pixel counter 400 while the developing device 5*d* is used for development, from the residual toner amount RBk in the developer container 21*d* in the developing device 5*d* (for black (Bk) color) detected in Step S5. If the difference is no more than the preset threshold value, the controller section 100 advances to Step S17, in which it displays a warning about the service life of the developing device 5*d* (for black (Bk) color), on the display 300*a* of the control panel 300.

Also, in Step S16, if the difference is no less than the preset threshold value, the controller section 100 advances to Step S18, in which it ends the on-going image forming operation.

That is, in the case of the developing device 5*a*, which is for developing an electrostatic latent image on the photosensitive drum 1 into a visible image of yellow (Y) color (first color), the residual toner amount (information about residual developer amount) in its developer container 21*a* detected in the developer amount detection position E by the residual toner amount detecting device 100*a* after the developing device 5*a* is used for the on-going image forming operation is used as the residual toner amount RY. Also in the case of the developing device 5*b*, which is for developing an electrostatic latent image on the photosensitive drum 1 into a visible image of magenta (M) color (second color), and which is on the upstream side of the development position H and on the downstream side of the developer amount detection position E in terms of the rotational direction of the rotary 50, when the developing device 5*a* is in the development position H, as shown in FIG. 1, the residual toner amount (information about residual developer amount) in its developer container 21*b* detected in the developer amount detection position E by the residual toner amount detecting device 100*a* after the developing device 5*b* is used for the on-going image forming operation is used as the residual toner amount RM.

On the other hand, in the case of the developing device 5*c*, which is in the developer amount detection position E when the developing device 5*a* is in the development position H, and also, in the case of the developing device 5*d*, which is on the upstream side of the developer amount detection position E and on the downstream side of the development position 11 (where developing device 5 opposes photosensitive drum 1), in terms of the rotational direction of the rotary 50, when the developing device 5*a* is in the development position H, the controller section 100 subtracts the value (as amount Pix by which toner in developing device 5*c* will be consumed during on-going image forming operation) estimated by the pixel counter 400, from the value obtained (as residual developer amount R in developing device) by the residual toner amount detecting device 100*a* in the developer amount detection point E. Then, it uses the differences (RC−PixC) and (Rbk−PixBk) as the residual developer amount in the developing device 5*c* and the residual developer amount in the developing device 5*d*, respectively.

In this embodiment, the length of time for the residual toner amount detecting device 100*a* to detect the residual amount of toner (developer) in the developer container 21 of the developing device 5 is set to be shorter than the length of time for the developing device 5 to use for development. Therefore, the controller section 100 detects the residual toner (developer) amount in the developer container 21 of the developing device 5 with the use of the residual toner amount detecting device 100*a* each time an image is formed.

However, there are sometimes occasions in which the length of time necessary for the residual toner amount detecting device 100*a* to detect the residual toner (developer) amount in the developer container 21 of the developing device 5 is longer than the length of time necessary for the developing device 5 to use for development. All that is necessary in such a case is that the controller section 100 detects the residual toner (developer) amount in the developer container 21 of the developing device 5 with the use of the residual toner amount detecting device 100*a* only with a preset timing, and reduces the image forming apparatus in image formation speed only during the detection of the residual toner (developer) amount.

With the use of the above described operational sequence for detecting the residual toner amount in the developer container 21 of the developing device 5, it is possible to inform a user of the precise amount of residual toner amount of the developer container 21 of the developing device 5, without requiring a specific length of time just for detecting the residual toner amount. As long as a user replaces the developing device 5 based on this information about the residual amount of toner in the developing device 5, it is possible to obtain images which do not suffer from unwanted white spots.

As described above, in this embodiment, the image forming apparatus employs the residual toner amount detecting device 100*a*, which measures the electrostatic capacity between the developer application roller 24 and development roller 25 to determine the amount of toner (developer) in the urethane sponge layer 29*a* of the developer application roller 24, and then, determines the residual amount of toner (developer) in the developer container 21 based on the amount of toner in the urethane sponge layer 29*a*. However, the present invention is also compatible with a residual toner amount detecting method other than the one used in this embodiment. While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 106016/2011 filed May 11, 2011 which is hereby incorporated by reference.

What is claimed is:

1. A color image forming apparatus comprising:

an image bearing member for carrying an electrostatic latent image;

a plurality of developing devices for effecting a developing operation for developing the electrostatic latent image;

a supporting member, supporting said developing devices, for moving said developing devices sequentially to a developing position opposing said image bearing member;

a detecting device for effecting a detecting operation at a position different from the developing position for detecting information relating to a developer remainder in said developing device;

deducing means for deducing a consumption amount of the developer from image information; and determining means for determining the developer remainder, wherein in color image formation, as to said developing device of said developing devices for which the detecting operation of said detecting device is effected after the developing operation therefor, said determining means determines the developer remainder from the information relating to the developer remainder detected by said detecting device, and as to said developing device of said developing devices for which the detecting operation of said detecting device is effected before the developing operation therefor, said determining means determines the developer remainder from the information relating to the developer remainder detected by said detecting device and the consumption amount deduced by said deducing means.

2. An apparatus according to claim 1, wherein during said developing device effecting the developing operation, said detecting device effects the detecting operation for another developing device not effecting the developing operation.

3. An apparatus according to claim 2, wherein the time required for the detecting operation of said detecting device is shorter than the time required for said developing operation of said developing device.

4. An apparatus according to claim 1, wherein said detecting device detects information relating to an electrostatic capacity between electrodes provided for each of said developing devices, as the information relating to the developer remainder.

5. An apparatus according to claim 1, wherein the image information is a number of print pixels.

6. An apparatus according to claim 1, wherein a warning is displayed on a display portion when the developer remainder is below a predetermined level.

7. A color image forming apparatus comprising:

an image bearing member for carrying an electrostatic latent image;

a plurality of developing devices for effecting a developing operation for developing the electrostatic latent image;

a supporting member, supporting said developing devices, for moving said developing devices sequentially to a developing position opposing said image bearing member;

a detecting device for effecting a detecting operation at a position different from the developing position for detecting information relating to a developer remainder in said developing devices;

a determining means for determining the developer remainder, and wherein in color image formation, as to said developing device of said developing devices for which the detecting operation of said detecting device is effected after the developing operation therefor, said determining means determines the developer remainder from the information relating to the developer remainder detected by said detecting device, and as to said developing device of said developing devices for which the detecting operation of said detecting device is effected before the developing operation therefor, said determining means determines the developer remainder from the information relating to the developer remainder detected by said detecting device and image information.

8. An apparatus according to claim 7, wherein during said developing device effecting the developing operation, said detecting device effects the detecting operation for another developing device not effecting the developing operation.

9. An apparatus according to claim 7, wherein the time required for the detecting operation of said detecting device is shorter than the time required for said developing operation of said developing device.

10. An apparatus according to claim 7, wherein said detecting device detects information relating to an electrostatic capacity between electrodes provided for each of said developing devices, as the information relating to the developer remainder.

11. An apparatus according to claim 7, wherein the image information is a number of print pixels.

12. An apparatus according to claim 7, wherein a warning is displayed on a display portion when the developer remainder is below a predetermined level.

* * * * *